US008517775B1

(12) United States Patent
Wang et al.

(10) Patent No.: US 8,517,775 B1
(45) Date of Patent: Aug. 27, 2013

(54) ELECTRICAL CONNECTOR

(75) Inventors: Yao-Ting Wang, New Taipei (TW); Yu-Hung Su, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/372,351

(22) Filed: Feb. 13, 2012

(51) Int. Cl.
*H01R 24/00* (2011.01)

(52) U.S. Cl.
USPC ..... 439/660

(58) Field of Classification Search
USPC ..... 439/660, 637, 630, 629, 260, 159, 439/137, 142
See application file for complete search history.

(56) References Cited

U.S. PATENT DOCUMENTS

| | | | | |
|---|---|---|---|---|
| 4,780,095 | A * | 10/1988 | Classon et al. | 439/637 |
| 5,259,768 | A * | 11/1993 | Brunker et al. | 439/60 |
| 6,394,823 | B1 * | 5/2002 | Dunham et al. | 439/108 |
| 6,695,647 | B2 * | 2/2004 | Tsai | 439/630 |
| 6,790,054 | B1 * | 9/2004 | Boonsue | 439/79 |
| 7,210,945 | B1 * | 5/2007 | Ying | 439/79 |
| 7,427,206 | B2 * | 9/2008 | Takei et al. | 439/159 |
| 7,442,089 | B2 * | 10/2008 | Regnier | 439/637 |
| 7,604,510 | B2 * | 10/2009 | Akama et al. | 439/637 |
| 7,654,835 | B1 * | 2/2010 | Chiang | 439/137 |
| 7,896,661 | B2 * | 3/2011 | Yao et al. | 439/83 |
| 7,914,330 | B2 * | 3/2011 | Su et al. | 439/607.31 |
| D638,365 | S * | 5/2011 | Hsu et al. | D13/147 |
| D638,802 | S * | 5/2011 | Arche et al. | D13/154 |
| 7,946,875 | B2 * | 5/2011 | Li et al. | 439/327 |
| 7,946,887 | B1 * | 5/2011 | Zhang et al. | 439/607.23 |
| D640,201 | S * | 6/2011 | Ngo | D13/147 |
| 8,007,303 | B2 * | 8/2011 | Yao et al. | 439/327 |
| 8,007,323 | B1 * | 8/2011 | Yao et al. | 439/660 |
| 8,052,461 | B2 * | 11/2011 | Wang | 439/405 |
| 8,079,873 | B2 * | 12/2011 | Shih | 439/607.28 |
| 8,342,886 | B2 * | 1/2013 | Zhang et al. | 439/660 |
| 8,353,726 | B2 * | 1/2013 | Zhang et al. | 439/629 |
| 2005/0101190 | A1 * | 5/2005 | Ong et al. | 439/637 |
| 2006/0128225 | A1 * | 6/2006 | Matsumoto et al. | 439/630 |
| 2006/0166560 | A1 * | 7/2006 | Shuey et al. | 439/637 |
| 2007/0010125 | A1 * | 1/2007 | Regnier | 439/495 |
| 2012/0077389 | A1 * | 3/2012 | Zhang et al. | 439/660 |

* cited by examiner

*Primary Examiner* — Alexander Gilman
(74) *Attorney, Agent, or Firm* — WPAT, P.C.; Anthony King

(57) ABSTRACT

An electrical connector includes an insulating housing which defines an inserting mouth penetrating through a front side thereof and terminal grooves communicating with the inserting mouth and each extending longitudinally to penetrate rearward through the insulating housing. A plurality of electrical terminals is assembled in the terminal grooves and each has a contact arm elastically stretching into the inserting mouth and defining a contact end. The insulating housing further defines a plurality of through holes penetrating vertically therethrough to connect with the inserting mouth and arranged in accordance with the contact ends of the electrical terminals. The through holes are used to provide action space for meeting movements of the contact ends and receiving the contact ends therein, when a mating part is inserted into the inserting mouth and pressure contacts with the contact ends.

9 Claims, 4 Drawing Sheets

ELECTRICAL CONNECTOR

BACKGROUND OF THE INVENTION

1. Field of the Invention

The present invention generally relates to an electrical connector, and more particularly to an electrical connector capable of meeting the miniaturization development of an electronic product where the electrical connector is used.

2. The Related Art

With the development of electronic technology, electronic products are more and more miniaturized. Accordingly, electrical connectors often used in the electronic products for achieving signal transmission among the electronic products also call for more stringent requirements to miniaturization thereof. The traditional electrical connector generally includes an insulating housing, a plurality of electrical terminals assembled in the insulating housing, and a shielding shell enclosing the insulating housing together with the electrical terminals. In use, the electrical connector is often engaged with a mating connector to realize electrical connection between the electrical terminals and mating terminals of the mating connector by virtue of squeezing one another outward. So, the inner height of the electrical connector need be enlarged to meet movements of the electrical terminals. As a result, the electrical connector occupies a large space in the electronic product so that is to the disadvantage of miniaturizing the electronic product.

Furthermore, the traditional electrical connector often utilizes a locking part to ensure a steady connection with the mating connector. But the locking part is apt to happen to displacement or be even ejected out in the process of inserting the mating connection into the electrical connector. As a result, it often fails to achieve the locking action between the electrical connector and the mating connector.

SUMMARY OF THE INVENTION

An object of the present invention is to provide an electrical connector adapted for connecting with a mating part. The electrical connector includes an insulating housing having a base portion and an inserting tongue extending forward from a front side of the base portion, and a plurality of electrical terminals. An inserting mouth is opened in the inserting tongue and penetrates through a front side of the inserting tongue. The inserting tongue defines a plurality of terminal grooves communicating with the inserting mouth and each further extending longitudinally to penetrate through the base portion. The electrical terminals are assembled in the terminal grooves of the insulating housing respectively, and each has a connecting arm, a contact arm and a soldering tail connected with two opposite ends of the connecting arm. The contact arm elastically stretches into the inserting mouth and defines a contact end. The soldering tail projects behind the base portion. The inserting tongue further defines a plurality of through holes penetrating vertically through the inserting tongue to connect with the inserting mouth and arranged in accordance with the contact ends of the electrical terminals. The through holes are used to provide action space for meeting movements of the contact ends and receiving the contact ends therein, when the mating part is inserted into the inserting mouth of the electrical connector and pressure contacts with the contact ends.

As described above, the electrical connector utilizes the through holes of the insulating housing to provide the action space for meeting the movements of the contact ends of the electrical terminals, when the mating part is inserted into the inserting mouth of the electrical connector and pressure contacts with the contact ends, so that are to the benefit of lowering a height of the electrical connector and miniaturizing the electrical connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
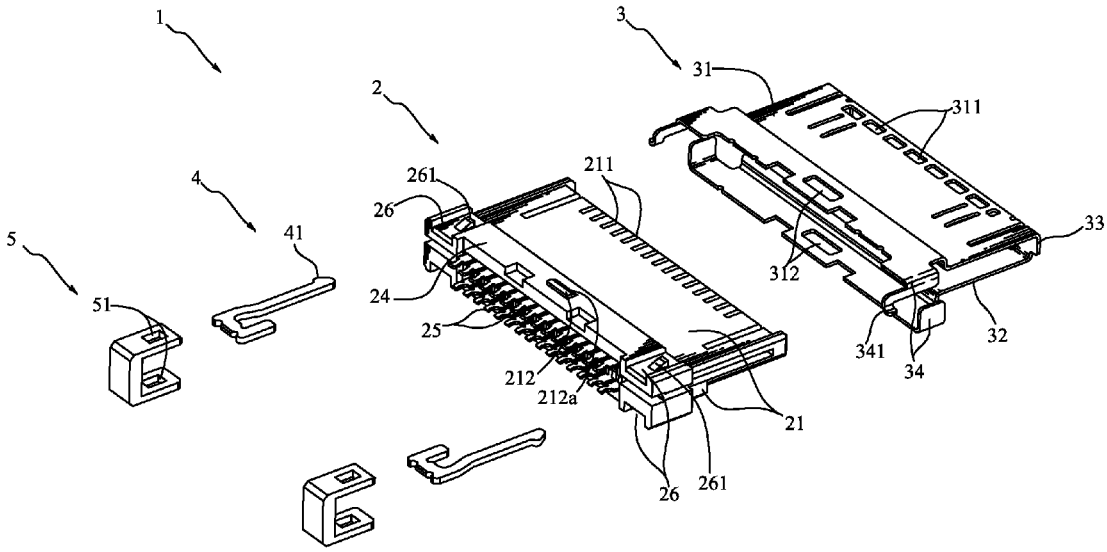
FIG. 1 is an exploded perspective view of an electrical connector according to an embodiment of the present invention.
Figure 2:
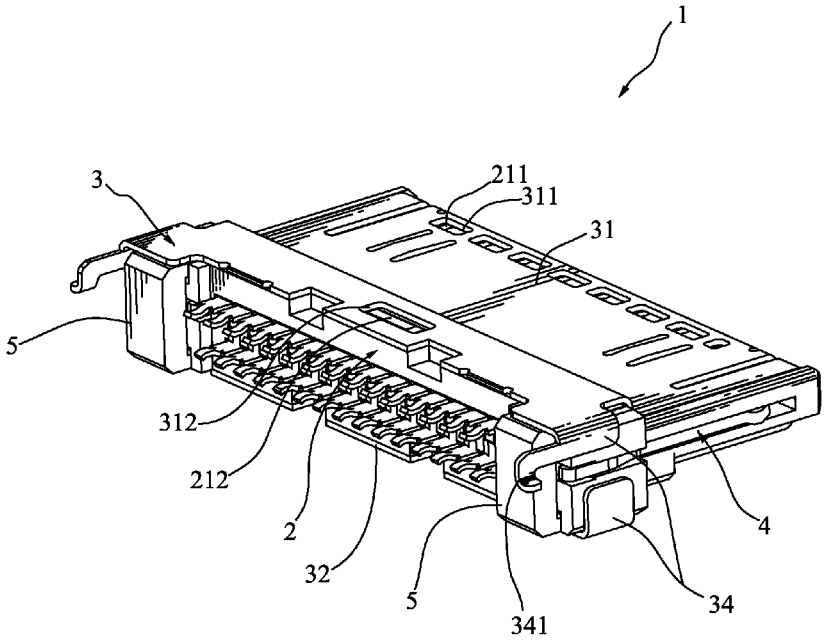
FIG. 2 is an assembled perspective view of the electrical connector of FIG. 1.

Referring to FIG. 1, an electrical connector 1 in accordance with an embodiment of the present invention is adapted for connecting with a mating part (not shown), and includes an insulating housing 2, a plurality of electrical terminals 25, a shielding shell 3, a pair of locking parts 4 and a pair of holding parts 5.

Figure 3:
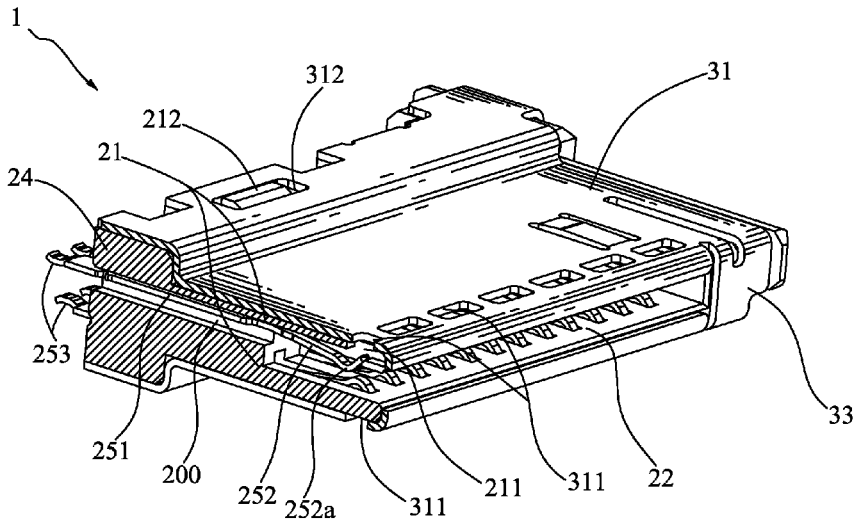
FIG. 3 is a sectional perspective view of the electrical connector of FIG. 2.
Figure 4:
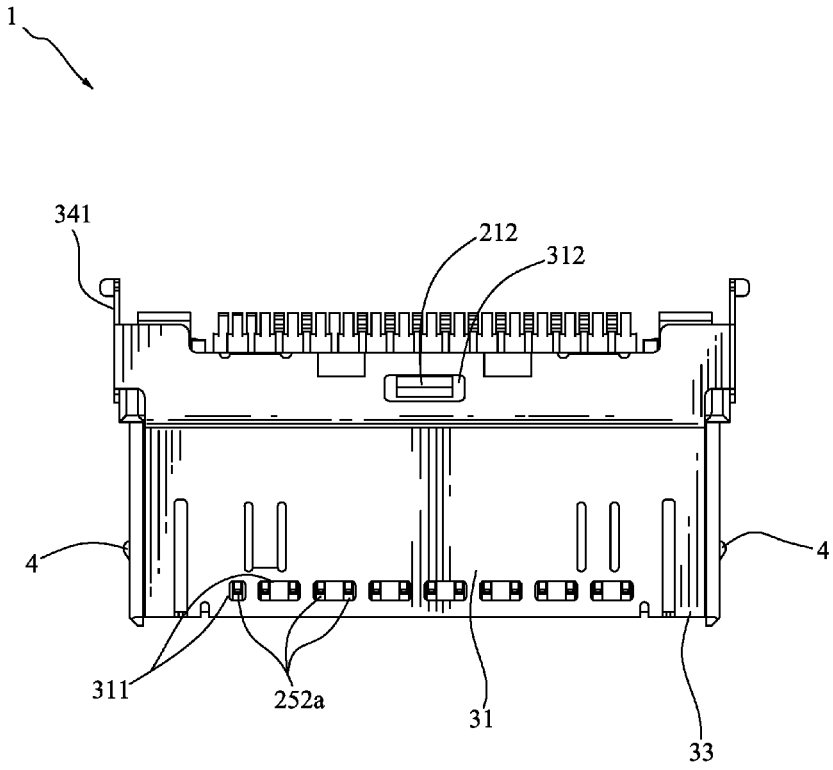
FIG. 4 is a vertical view of the electrical connector of FIG. 2.

Referring to FIG. 1 and FIG. 3, the insulating housing 2 has a base portion 24 and an inserting tongue 21 extending forward from a front side of the base portion 24. An inserting mouth 22 is opened in the inserting tongue 21 and penetrates through a front side of the inserting tongue 21. The inserting tongue 21 defines a plurality of terminal grooves 200 communicating with the inserting mouth 22 and each further extending longitudinally to penetrate through the base portion 24. The electrical terminals 25 are assembled in the terminal grooves 200 of the insulating housing 2 respectively, and each has a connecting arm 251, a contact arm 252 and a soldering tail 253 connected with two opposite ends of the connecting arm 251. The contact arm 252 elastically stretches into the inserting mouth 22 and defines a contact end 252*a*. The soldering tail 253 projects behind the base portion 24. The inserting tongue 21 further defines a plurality of through holes 211 penetrating vertically through the inserting tongue 21 to connect with the inserting mouth 22 and arranged in accordance with the contact ends 252*a* of the electrical terminals 25. The through holes 211 are used to provide action space for meeting movements of the contact ends 252*a* and receiving the contact ends 252*a* therein, when the mating part is inserted into the inserting mouth 22 of the electrical connector 1 and pressure contacts with the contact ends 252*a*.

Referring to FIGS. 1-4, the shielding shell 3 of substantial C-shape has a top plate 31 and a bottom plate 32 apart paralleling to each other and connected by two connecting plates 33 therebetween. The shielding shell 3 is put rearward around the insulating housing 2 with the connecting plates 33 abutting against two ends of the front side of the inserting tongue 21 for further exposing the inserting mouth 22 outward. The top plate 31 and the bottom plate 32 respectively define a plurality of receiving cavities 311 penetrating vertically through the top plate 31 and the bottom plate 32 and arranged in accordance with single one or many of the through holes 211 respectively to further enlarge the action space for the contact ends 252*a* of the electrical terminals 25. Rear ends of side edges of the top plate 31 and the bottom plate 32 bend vertically towards one another to form two pairs of clamping walls 34 standing together to hold the base portion 24 thereamong. The clamping walls 34 formed from the top plate 31 protrude rearward to form a pair of ground tails 341 projecting behind the base portion 24. A top and a bottom of the base portion 24 protrude oppositely to form at least one fastening portion 212 respectively. Rears of the top plate 31 and the bottom plate 32 respectively define at least one buckling structure 312 buckling the fastening portion 212 therein. In this embodiment, the buckling structure 312 is a buckling hole, and a front of the fastening portion 212 is cut off to define a guiding slope 212*a* for the convenience of the fastening portion 212 being buckled into the buckling hole.

The locking parts 4 are inserted forward in two opposite sides of the insulating housing 2 and have a pair of locking blocks 41 oppositely protruding sideward out of two opposite side faces of the inserting tongue 21 for securing the mating part and the electrical connector 1 together. The holding parts 5 of substantial lying-U shape grip two ends of a rear of the base portion 24 and are located behind the corresponding locking parts 4 to restrain the locking parts 4 in the insulating housing 2. Top and bottom sides of each end of the rear of the base portion 24 are face-to-face concaved inward to form a pair of gripping fillisters 26 with a pair of gripping wedges 261 oppositely protruding therein. Two arms of each holding part 5 are inserted in the gripping fillisters 26 with two opposite outer faces thereof being flush with or lower than the top and bottom sides of the base portion 24, and define a pair of gripping holes 51 for gripping the gripping wedges 261 therein.

As described above, the electrical connector 1 utilizes the cooperation of the through holes 211 of the insulating housing 2 and the receiving cavities 311 of the shielding shell 3 to provide the action space for meeting the movements of the contact ends 252*a* of the electrical terminals 25, when the mating part is inserted into the inserting mouth 22 of the electrical connector 1 and pressure contacts with the contact ends 252*a*, so that are to the benefit of lowering a height of the electrical connector 1 and miniaturizing the electrical connector 1. Furthermore, the holding parts 5 are mounted to the two ends of the rear of the base portion 24 and located behind the corresponding locking parts 4 to restrain the locking parts 4 in the insulating housing 2. So, a steady connection is realized between the mating part and the electrical connector 1.

What is claimed is:

1. An electrical connector adapted for connecting with a mating part, comprising:

an insulating housing having a base portion and an inserting tongue extending forward from a front side of the base portion, an inserting mouth being opened in the inserting tongue and penetrating through a front side of the inserting tongue, the inserting tongue defining a plurality of terminal grooves communicating with the inserting mouth and each further extending longitudinally to penetrate through the base portion;

a plurality of electrical terminals assembled in the terminal grooves of the insulating housing respectively, each electrical terminal having a connecting arm, a contact arm and a soldering tail connected with two opposite ends of the connecting arm, the contact arm elastically stretching into the inserting mouth and defining a contact end, the soldering tail projecting behind the base portion; and a pair of locking parts and a pair of holding parts, the locking parts are inserted forward in two opposite sides of the insulating housing and have a pair of locking blocks oppositely protruding sideward out of two opposite side faces of the inserting tongue for securing the mating part and the electrical connector together, the holding parts are mounted to two ends of a rear of the base portion and located behind the corresponding locking parts to restrain the locking parts in the insulating housing, wherein the inserting tongue further defines a plurality of through holes penetrating vertically through the inserting tongue to connect with the inserting mouth and arranged in accordance with the contact ends of the electrical terminals, the through holes are used to provide action space for meeting movements of the contact ends and receiving the contact ends therein, when the mating part is inserted into the inserting mouth of the electrical connector and pressure contacts with the contact ends.

2. The electrical connector as claimed in claim 1, further comprising a shielding shell which has a top plate and a bottom plate apart paralleling to each other and connected by two connecting plates therebetween, the shielding shell is put rearward around the insulating housing with the connecting plates abutting against two ends of the front side of the inserting tongue for further exposing the inserting mouth outward, the top plate and the bottom plate respectively define at least one receiving cavity cooperating with the through holes to further enlarge the action space for the contact ends of the electrical terminals.

3. The electrical connector as claimed in claim 2, wherein the top plate and the bottom plate define a plurality of the receiving cavities arranged in accordance with single one or many of the through holes respectively.

4. The electrical connector as claimed in claim 2, wherein the shielding shell is of substantial C-shape, and the receiving cavity penetrates vertically through the top plate or the bottom plate.

5. The electrical connector as claimed in claim 2, wherein rear ends of side edges of the top plate and the bottom plate bend vertically towards one another to form two pairs of clamping walls standing together to hold the base portion thereamong, the clamping walls formed from the top plate protrude rearward to form a pair of ground tails projecting behind the base portion.

6. The electrical connector as claimed in claim 2, wherein a top and a bottom of the base portion protrude oppositely to form at least one fastening portion respectively, rears of the top plate and the bottom plate respectively define at least one buckling structure buckling the fastening portion therein.

7. The electrical connector as claimed in claim 6, wherein the buckling structure is a buckling hole, a front of the fastening portion is cut off to define a guiding slope for the convenience of the fastening portion being buckled into the buckling hole.

8. The electrical connector as claimed in claim 1, wherein the holding parts are of substantial lying-U shape and grip the two ends of the rear of the base portion respectively.

9. The electrical connector as claimed in claim 8, wherein top and bottom sides of each end of the rear of the base portion are face-to-face concaved inward to form a pair of gripping fillisters with a pair of gripping wedges oppositely protruding therein, two arms of each holding part are inserted in the gripping fillisters with two opposite outer faces thereof being flush with or lower than the top and bottom sides of the base portion, and define a pair of gripping holes for gripping the gripping wedges therein.

* * * * *